United States Patent [19]

Zwingel et al.

[11] Patent Number: 4,930,394

[45] Date of Patent: Jun. 5, 1990

[54] BARRELED WEAPON WITH CHEMICAL-ELECTRICAL HYBRID PROPULSION THROUGH REGENERATIVE PROPELLANT INJECTION

[75] Inventors: Dieter Zwingel, Simmelsdorf; Gunther Lochner, Altdorf; Sonke Bleickert, Ruckersdorf, all of Fed. Rep. of Germany

[73] Assignee: Diehl GmbH & Co., Nuremberg, Fed. Rep. of Germany

[21] Appl. No.: 360,004

[22] Filed: Jun. 2, 1989

[30] Foreign Application Priority Data

Jun. 16, 1988 [DE] Fed. Rep. of Germany ..... 3820492

[51] Int. Cl.[5] ..... F41D 7/06; F41F 1/00; F42B 13/16

[52] U.S. Cl. ..... 89/7; 89/8

[58] Field of Search ..... 89/7, 8

[56] References Cited

U.S. PATENT DOCUMENTS

| | | | |
|---|---|---|---|
| 4,376,406 | 3/1983 | Black | 89/7 |
| 4,523,508 | 6/1985 | Mayer et al. | 89/7 |
| 4,664,631 | 5/1987 | Pederson et al. | 89/7 |
| 4,693,165 | 9/1987 | Magoon | 89/7 |

FOREIGN PATENT DOCUMENTS 3153053 3/1982 Fed. Rep. of Germany .

*Primary Examiner*—David H. Brown

*Attorney, Agent, or Firm*—Scully, Scott, Murphy & Presser

[57] ABSTRACT

A barreled weapon with chemical-electrical hybrid propulsion through the intermediary of regenerative injection of fluid propellants through at least one axially movable piston. The propellant components and/or the gases which are developed due to the reaction of the propellant components, are forcibly conducted past an electrode arrangement of a plasma burner in such a manner whereby the electrical energy of a light corona or arc discharge is coupled into the matter streaming therepast.

6 Claims, 2 Drawing Sheets

BARRELED WEAPON WITH CHEMICAL-ELECTRICAL HYBRID PROPULSION THROUGH REGENERATIVE PROPELLANT INJECTION

BACKGROUND OF THE INVENTION

1. Field of the Invention

The present invention relates to a barreled weapon with chemical-electrical hybrid propulsion through the intermediary of regenerative injection of fluid propellants through at least one axially movable piston.

2. Discussion of the Prior Art

At this time, there is already common knowledge of barreled weapons with regenerative injection of fluid propellants, which operate with the use of either monergolic or diergolic liquids. In the utilization of monergolic propellants, for example, the propellant is injected by a differential piston during the combustion operation, as a result of which there is given an overall regulated combustion cycle. However, in all instances, the energy consumption which is required for the driving of the piston is relatively high.

Pursuant to another system, the monergolic propellant is pumped into a space or chamber behind the projectile and ignited therein, whereby the projectile assumes the sealing relative to the weapon barrel. This system is simple in its construction; nevertheless, there is encountered significant difficulties in attempting to achieve a precise triggering and a reproducible combusting or deflagration.

From the disclosure of German Patent 31 53 053 there has become known a liquid propellant-artillery or cannon arrangement with a direct injection, in which a T-shaped differential-pressure piston is axially movably arranged in a breech housing behind the cannon or gun barrel. The differential-pressure piston possesses an axial bore which extends through its head and shaft for the reloading of projectiles. This known arrangement represents an extremely complicated apparatus which has a large constructional volume and in which the loading and discharge of a cartridge or shell is solved in a technologically complex manner.

In addition thereto, in connection with barreled weapons providing for regenerative injection of chemical propellants, there is encountered the general drawback that, with the currently known technology, it is not possible to attain muzzle velocities for the projectiles of significantly above 2200 m/sec., in order to be able to meet the future demands of a modern high-performance barreled weapon.

As is known, extremely high muzzle velocities for the projectile are attained in so-called electrothermal cannons. This occurs through the employment of electrical energy which is transmitted to a work medium through the electric arc discharge in a plasma burner. With the present state-of-the-art in the technology, the spatial requirement and the mass of the necessary electrical accumulators are too large in size to be able to be built into a combat vehicle which can be employed by troops.

SUMMARY OF THE INVENTION

Accordingly, it is an object of the present invention to provide a barreled weapon of the above-mentioned type which, with a simple kind of construction, small requirements of space and without any excessive increases in technological requirements, facilitates the attainment of extremely high muzzle velocities for the projectiles.

This object is inventively achieved in that the propellant components and/or the gases which are developed due to the reaction of the propellant components, are forcibly conducted past an electrode arrangement of a plasma burner in such a manner whereby the electrical energy of a light corona or arc discharge is coupled into the matter streaming therepast.

The decisive advantage of this barreled weapon resides in that there is attained a muzzle velocity which lies significantly above the values which are presently achievable through barreled weapons with a liquid propulsion or a powder drive. Concurrently, by means of this inventive combination, there is achieved a reduction in the demands on storage or accumulator capacity and also with regard to the energy supply in comparison with purely electrically-operated accelerators.

Further advantages afforded themselves in that there becomes possible the utilization of different liquid propellant combinations, for example, such as monergoles, and which no longer evidence the special safety problems of highly- energetic monergoles. At an suitable selection of propellants, the fluid propellant for the barreled weapon can additionally also be employed for the operation of the primary energy generator of the electrical propulsion components.

Finally, no separate triggering is necessary for the fluid propulsion. The inlet pressure which is required for the injection is generated by the ignition of the corona or light arc in the plasma burner.

Pursuant to a specific embodiment of the invention, the plasma burner can be constructed annularly or ring-shaped, and arranged in the rearward region of the projectile magazine in the weapon housing or in the weapon barrel, whereby its inner flow-through opening is in open communication with the combustion chamber and/or the passageways for the combustion gases and uncombusted portions of the propellant components. Furthermore, the plasma burner can be a ring-shaped member constituted of electrically-insulating material, which is inserted into the cylinder wall of the projectile chamber so as to be axially and radially undisplaceable, whereas a ring-shaped electrode with an electrically-insulated supply line of an energy source which is conducted out from the weapon housing or the weapon barrel is inserted into the inner mantle surface in the forward region of the member while the second electrode is electrically-conductively connected with the weapon housing.

In a particular embodiment of this inventive concept, the ring-shaped electrode can be formed from individual segments which are presently connected with their own electrically-insulated supply lines, and in their arrangement and quantity correspond to the location and the number of the passageways for the liquid and/or gaseous propellant components. The arrangement of a plurality of individual segments, in an advantageous manner, facilitates a controlled, time-staggered coupling of the energy.

The ring-shaped body of the plasma burner can possess a certain number of axially-parallel bores which are streamed through by the propellant components and which serve as a discharge structure for the corona or electric arcs, which are ignited between the applicable electrodes, whereby the outflow of the propellant in proximity to the first electrode is carried out through suitably selected bores in the charging chamber behind the propulsion mechanism for a projectile.

For the ignition of the electric arc there can be employed an electrically-conductive coating on the otherwise insulated rearward portion of a propulsion mechanism or propellant cage for a projectile which is introduced into the projectile chamber, whereby the second electrode selectively corresponds in the arrangement and quantity thereof with the first ring-shaped or segmented electrode.

BRIEF DESCRIPTION OF THE DRAWING

Further features and advantageous embodiments can now be readily ascertained from the following detailed description of an exemplary construction of a barreled weapon with a ring-shaped arrangement of a single injection piston, wherein.

Figure 1:
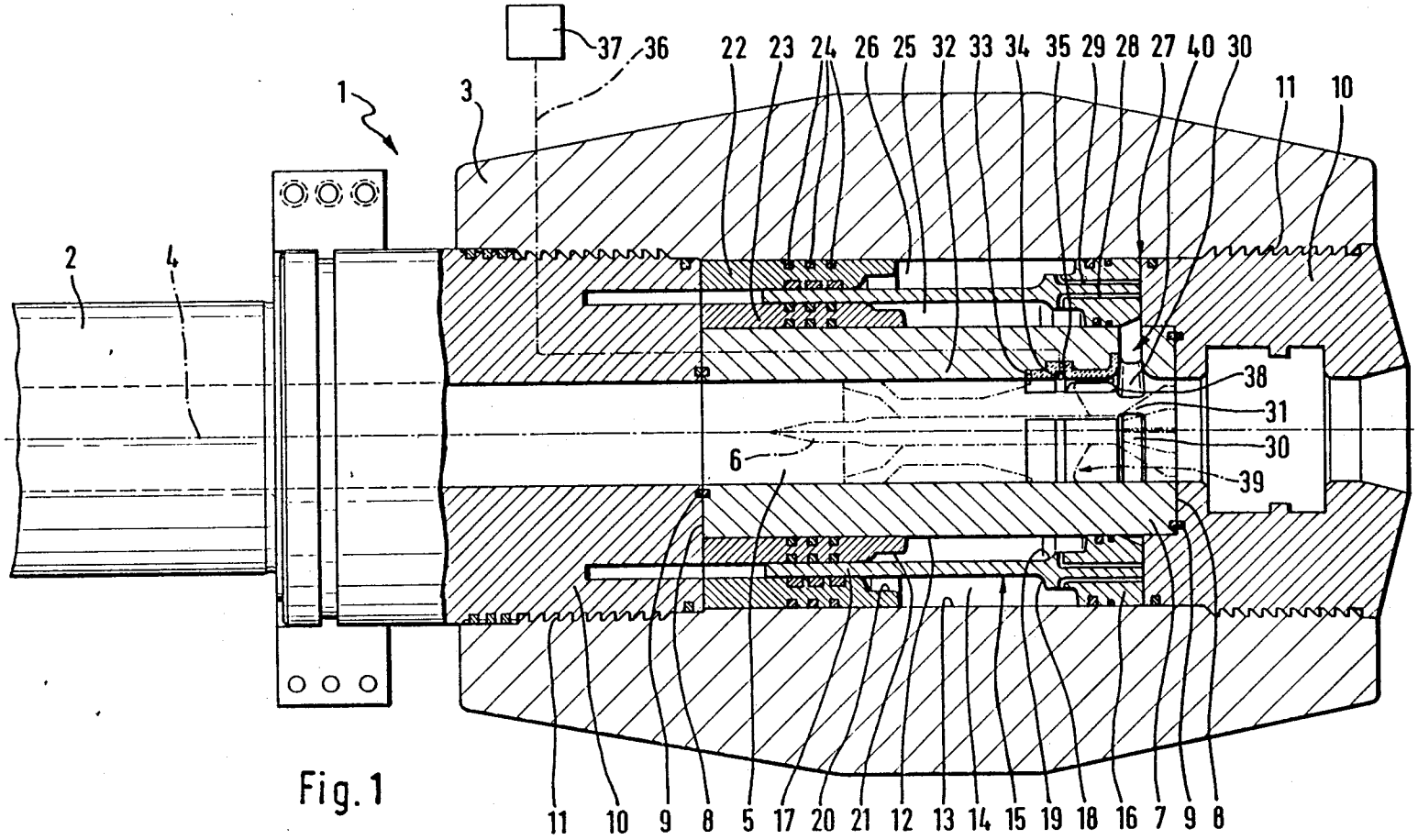
FIG. 1 illustrates, partly in longitudinal section, the barreled weapon with regenerative propellant injection and with the installation of a plasma burner.

However, it is to be noted that other injection concepts can also be selected, which have a plasma burner associated therewith without deviating from the scope of the invention. For example, it is possible to employ two ring pistons, which are located opposite each other. In the same manner, a single injection piston can also be arranged axially behind the weapon barrel. Furthermore, there can be provided one or more separate injection systems either radially or axially or in interposition relative to the bore axis of the weapon barrel.

DETAILED DESCRIPTION OF THE PREFERRED EMBODIMENT

The barreled weapon 1 possesses a weapon housing 3 at the rearward end of the weapon barrel 2. Arranged in the weapon housing 3 is the projectile chamber 5 coaxially of the bore axis 4, into which there is introduced a projectile 6 with propellant mechanism and which is in readiness for firing. The projectile chamber 5 is formed by a cylindrical caliber part 7 which has its end surfaces 8, with the respective interposition of sealing rings 9, bounding insert pieces 10 axially contacting against the caliber part 7. The insert pieces 10 are connected in a close fit with the weapon housing 3 through the intermediary of a screw connection 11.

Intermediate the outer mantle surface 12 of the caliber part 7 and the inner mantle surface 13 of the weapon housing 3 there is formed a ring-shaped cylinder or annulus 14, into which there is inserted a ring piston 15 so as to be axially movable. The ring piston 15 possesses a piston head 16 and a piston shaft 17, whereby the transitions between the piston head 16 and the piston shaft 17 incorporates steps 18 and 19 at the radially inwardly and radially outwardly located side, which extend into corresponding cutouts 20 and 21 in sealing supports 22 and 23 upon their rearward contact. The sealing supports 22 and 23 possess sealing elements 24 in annular grooves so as to, in this manner, achieve a radial sealing of the loading chambers 25 and 26 behind the piston head 16.

Extending from the end surface of the ring piston head 16 are inlet passageways 28 and 29 which connect into the loading chambers 25 and 26.

In the region of the contacting plane 27 of the end surface of the piston head with the oppositely located end surface of the insert piece 10, radial cutouts 30 are provided in the cylindrical wall of the caliber part 7, whose through-passing surface is at least equal in size to the cross-sectional surface of the projectile chamber 5.

The ring-shaped encompassingly arranged cutouts 30 are presently separated from each other by webs or connectors 31.

The breakthroughs or cutouts 30 connect as passageways from the combustion chamber in the contact plane 27 in the projectile chamber 5 into the rearward region. Immediately axially in front of the passageways 30, there is inserted into respective recesses in the cylindrical wall 32 of the projectile chamber 5 a ring-shaped plasma burner 33 consisting of an electrically-insulating material; for example, ceramic, so as to be axially and radially non-displaceable. This ring-shaped plasma burner 33 with the ring-shaped electrode 34 which is inserted in the forward region, and which is inserted into an annular groove 35 of the plasma burner.

Figure 2:
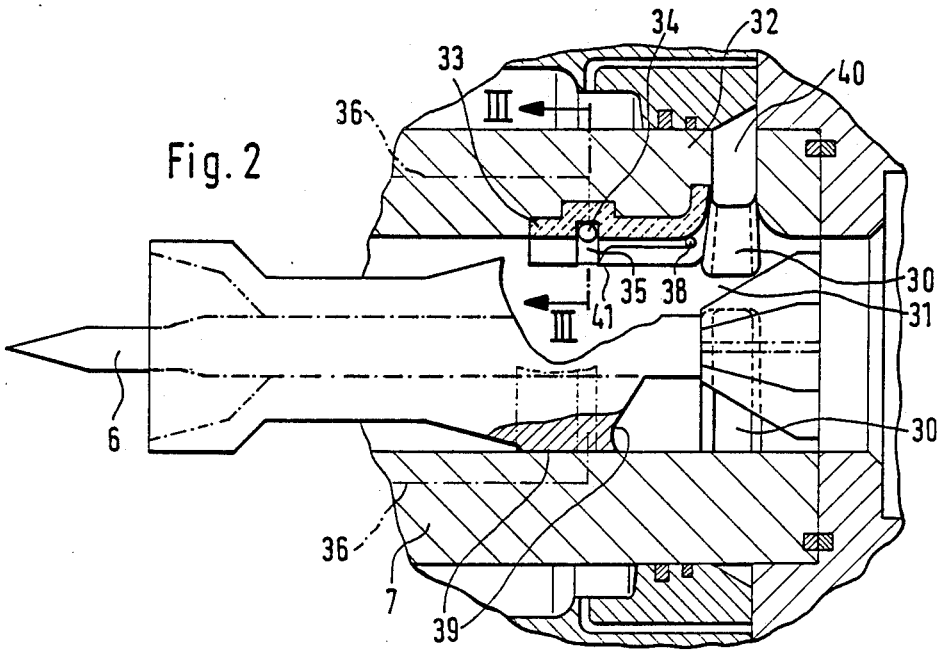
FIG. 2 illustrates an exploded view of the area circled as detailed in circle II of FIG. 1.
Figure 3:
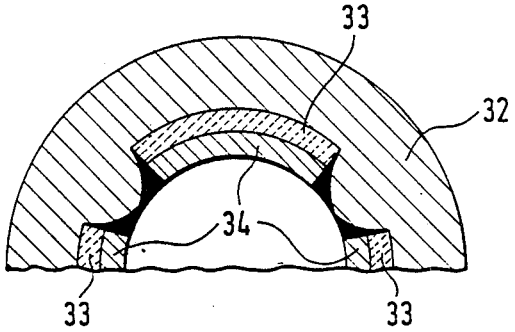
FIG. 3 illustrates a cross-section of the barreled weapon taken along lines III—III of FIG. 2.

As best seen in FIG. 2, in the illustrated embodiment, the electrode 34 is formed from a total of three mutually separated ring segments, which are respectively connected with their own electrically-insulated supply lines 36 from an energy source 37. Hereby, the quantity of segments corresponds to the number of the passageways 30. The position of the individual segments of the ring-shaped electrode 34 is presently located in the region of the breakthroughs or passageways 30 in the caliber part 7. The required second electrode 38 is situated at the rearward end of the discharge section of plasma burner 33, and stands in electrical contact with the caliber part 7 as at 41. The ignition of the electric arc is effected through a thin electrically-conductive layer or coating which is provided on the surface of the propulsion mechanism 39, which at this location is covered with an insulating coating. The arrangement and the quantity of the electrically-conductive layers herein again corresponds to the position and the quantity of the individual segments of the first electrode 34.

After a suitable ignition of the electric arc, a gas pressure is built up in the passageways 30 and the region of the combustion chamber ahead of the injection piston 15, which causes the axial injecting movement of the piston 15. In order to improve upon the buildup in the gas pressure, parts of the propulsion mechanism 39 which is formed as an insulator can be vaporized by the electric arc.

The propellant components 40, and/or the gases which are generated during the reaction of the propellant components 40, pass through he passageways 30 behind the projectile 6 into the projectile chamber 5, as a result of which the projectile is accelerated. During the streaming past of the combustion gases and the partly unconverted propellant components 40 through the plasma burner 33, there is furthermore concurrently effectuated the discharge of the electric arc across the two electrodes 34 and 38, such that the thereby generated electrical energy is coupled into the matter therepast. This has the consequence, that the matter streaming therepast is raised up to an extremely high velocity. At a suitable selection of the propellant components 40 there are additionally produced combustion products possessing low molecular weights. Obtained therefrom due to known internal ballistic conditions, is that the projectile will exit the weapon barrel 2 with a significantly increased muzzle velocity in comparison with currently usual weapons.

What is claimed is:

1. A barreled weapon for electrical-chemical hybrid propulsion of projectiles through the intermediary of regenerative injection of fluid propellants, comprising a housing, at least one axially movable piston, a plasma burner having an electrode arrangement for producing a electric arc discharge, and a projectile chamber, wherein propellant gases are generated by reaction of said fluid propellant components, said gases being forcibly conducted past said electrode arrangement of said plasma burner; and the electrical energy of said electric arc discharge is coupled into matter formed by said gases streaming therepast.

2. A barrelled weapon as claimed in claim 1, wherein said plasma burner comprises a plurality of arcuate shaped segments forming a ring and is arranged in a rearward region of said projectile chamber of said weapon barrel housing or in the weapon barrel, whereby an inner through flow opening of said chamber is in axial alignment with said plasma burner, said plasma burner having an inward flow opening in open communication with a combustion chamber or passageways for the combustion gases and any unconverted parts of the propellant components.

3. A barrelled weapon as claimed in claim 2, wherein said plasma burner comprises a plurality of arcuate shaped segments forming a ring of an electrically-insulating material, said burner being immovably positioned in a cylindrical wall of said projectile chamber, an inner mantle surface in the forward region of said member having an electrode comprising a plurality of arcuate shaped segments forming a ring with electrically-insulating supply lines from an energy source conducted out of said weapon housing or from the weapon barrel being inserted therein; and a second electrode being electrically-conductively connected with said weapon housing.

4. A barrelled weapon as claimed in claim 3, wherein said ring-shaped electrode comprises individual segments, electrically-insulated supply lines separately connecting each of said segments.

5. A barrelled weapon as claimed in claim 3, wherein said plasma burner includes a predetermined number of axially-parallel bores which are streamed through by the propellant components and which constitute discharge structure for electric arcs initiated across the respective electrodes, and the discharge of the propellant is effected in proximity to the first electrode through selected bores in the loading chamber behind a propulsion mechanism of a projectile.

6. A barreled weapon as claimed in claim 3, wherein an electrically-conductive coating is arranged on the remaining insulated rearward portion of a propulsion mechanism or propellant cage of a projectile which is inserted into the projectile chamber for igniting of the electric arc, and wherein the second electrode is selectively in an arrangement and quantity which corresponds to that of the ring-shaped segmented electrode.

* * * * *